United States Patent [19]

Tuenkers

[11] Patent Number: 4,625,811

[45] Date of Patent: Dec. 2, 1986

[54] HYDRAULIC VIBRATORY PILE DRIVER

[76] Inventor: Josef-Gerhard Tuenkers, Bahnstrasse 46, Ratlingen 1, Fed. Rep. of Germany

[21] Appl. No.: 576,620

[22] Filed: Feb. 3, 1984

[30] Foreign Application Priority Data

Feb. 3, 1983 [DE] Fed. Rep. of Germany ..... 3303574

[51] Int. Cl.[4] ..... E02D 7/18

[52] U.S. Cl. ..... 173/49; 74/61; 173/112

[58] Field of Search ..... 173/49, 162 R; 175/55, 175/56; 74/61

[56] References Cited

U.S. PATENT DOCUMENTS

| | | | |
|---|---|---|---|
| 2,420,793 | 5/1947 | O'Conner | 173/49 |
| 3,004,389 | 10/1961 | Müller | 74/61 |
| 3,312,295 | 4/1967 | Bodine, Jr. | 173/56 |
| 3,407,670 | 10/1968 | Venanzetti | 74/61 |
| 3,477,237 | 11/1969 | Orkney | 173/49 |
| 3,828,864 | 8/1974 | Haverkamp et al. | 173/49 |
| 4,135,585 | 1/1979 | Wagner | 173/49 |

*Primary Examiner*—Donald R. Schran
*Assistant Examiner*—James L. Wolfe
*Attorney, Agent, or Firm*—Dick and Harris

[57] ABSTRACT

A vibratory pile driver has a rigid housing, a pair of parallel and horizontally spaced shafts journaled for rotation wholly independently of each other about respective parallel and horizontally spaced axes in the housing, respective generally equally massive and eccentrically mounted weights on the shafts, and respective nonpositive hydraulic drive motors on the housing connected to the shafts for oppositely rotating the shafts and the respective weights. Thus the weights are independently and nonpositively driven and are not mechanically linked together so that the horizontal components of their rotation cancel each other out and the two opposite rotations automatically synchronize themselves with each other.

7 Claims, 4 Drawing Figures

HYDRAULIC VIBRATORY PILE DRIVER

FIELD OF THE INVENTION

The present invention relates to a hydraulic vibratory pile driver. More particularly this invention concerns such a driver and a method of operating same.

BACKGROUND OF THE INVENTION

A standard vibratory pile driver has a heavy housing provided with at least two shafts carrying eccentric weights. The shafts are rotated at high speed to vibrate the housing which is clamped to the upper end of the pile to be driven. This vibration, combined with the weight of the driver, causes the pile to sink into the ground or bottom, or conversely the housing can be pulled upward so the vibration loosens the pile and it can be pulled out. Typically the housing is suspended by means of an elastomeric vibration damper from the cable of a crane so that the vertical vibration is transmitted to the pile, not back up the cable to the crane.

Such an arrangement is used to drive sheet piling for forming bulkheads below ground, for canals, or around foundations. Hydraulic power is preferred because it eliminates the danger of electricity when working around water and allows a stepless adjustment of vibration rate. In addition hydraulic motors can be made very compact even when relatively powerful.

It has always been considered necessary to link the various shafts together. This is typically done by providing continuous-mesh gearing between them so that the rotation of the drive motor is positively transmitted to one shaft and thence via the gear train to the other shaft or shafts. Such gearing obviously wastes power and requires lubrication and frequent servicing. The high peripheral speed of such gearing is often near the limit it is rated for. Normal gears are rated at a peripheral speed of at most 18 m/sec, whereas in a typical vibratory hammer the speed can approach 30 m/sec, putting an excessive strain on the gears. As a result the gearing interconnecting the shafts of the pile driver usually has an excessively short service life. The high speed further heats the lubricating oil for the gearing, requiring special construction to dissipate and/or withstand this heat.

Another problem with these systems is that the gearing generates a great deal of noise. Whereas the hydraulic motor of the driver can operate almost perfectly silently, the gearing can produce a high-pitched whine that is close to the maximum tolerable sound limit. Workers closely exposed to the driver must wear ear protectors, and the noise level increases as the gears wear.

Another problem with the known driver is that it is very heavy and, due to accommodating the above-described gearing inside its housing, is relatively tall. Thus the center of gravity of the driver lies well above the top of the pile to which it is clamped. If insufficient tension is maintained on the cable from which the driver is suspended, it can tip to the side and fall or at least damage the pile being driven.

Finally the ability of the known pile driver to pull a pile is often considerably limited by the vibration damper that is provided as part of the housing, which damper further increases the height of the unit. In order to effectively damp the vibrations of the machine and protect the crane from them, heavy coil-spring or block-type damping units are provided which can only transmit limited tension. If therefore becomes necessary to exert a relatively low tension when extracting a pile, or the damper is damaged.

OBJECTS OF THE INVENTION

It is therefore an object of the present invention to provide an improved pile driver.

Another object is the provision of such a pile driver which overcomes the above-given disadvantages, that is which operates efficiently and quietly, and which can be made relatively compact.

Yet another object is the provision of a method of operating a pile driver which overcomes the operational disadvantages of the known drivers.

SUMMARY OF THE INVENTION

In a vibratory pile driver wherein a pair of eccentric weights are rotated about respective axes according to this invention the axes are horizontally spaced and the weights are rotated in opposite directions. In addition the weights are independently and nonpositively driven and are not mechanically linked together. Thus the horizontal components of their rotation cancel each other out and the two opposite rotations automatically synchronize themselves with each other.

It has surprisingly been found that the system of this invention is perfectly self-synchronizing. The nonpositive driving, by which is meant that a drive motor is used that does not produce a predetermined angular displacement and/or velocity when energized at a predetermined level but wherein the output speed is dependent in large part on loading, insures such self-synchronization because the load on the motors will be increased if they go out of synchronization, automatically bringing the two rotations back into synchronization.

This self-synchronization only works when the vibrator cell or housing in which the eccentrically weighted shafts are journaled has no horizontally spring-mounted masses. Thus according to this invention the elastic vibration-damping carrying unit is not mounted on the top of the housing. Instead it can be provided somewhat above the housing on the suspensory cable, as described in German patent document No. 2,823,953. Such construction greatly reduces the overall height of the hammer and lowers its center of mass.

Thus a vibratory pile driver according to the invention has a rigid housing, a pair of parallel and horizontally spaced shafts journaled for rotation wholly independently of each other about respective parallel and horizontally spaced axes in the housing, respective generally equally massive and eccentrically mounted weights on the shafts, and respective nonpositive hydraulic drive motors on the housing connected to the shafts for oppositely rotating the shafts and the respective weights.

The hydraulic pile driver can also have an upright guide post, a guide vertically slidable on the post, and elastomeric spring means between the guide and the housing permitting limited relative vertical displacement and inhibiting relative horizontal displacement. This guide according to the invention is downwardly U-shaped and has a pair of sides. The housing has a part projecting upward between the sides of the guide and the elastomeric spring means includes a pair of blocks wedged between the housing part and the sides of the guide.

The hydraulic motors of the system of this invention are hydraulically coupled together. They are hydrostatic and are powered by a common pump. In addition the weights and shafts are substantially identical.

The vibration damper can be formed by a succession of inextensible but flexible links. Two upper links have upper ends jointly pivoted at a common eye on the crane hook and lower ends pivoted on the upper ends of respective abutment plates. Two lower links have upper ends pivoted on the lower ends of the abutment plates and lower ends pivoted together and connected to the housing, either directly or via another inextensible link member. A spring body is provided braced and compressed horizontally between the two abutment plates. This body is preferably a hollow and barrel-shaped elastomeric block. Such a damper effectively isolates the crane from the vertical vibration of the housing, as the spring body merely expands and contracts horizontally as the housing jumps up and down. When pulling, such a damper remains effective, while being able to transmit considerable tension to the pile to which the driver is clamped.

DESCRIPTION OF THE DRAWING

The above and other features and advantages will become more readily apparent from the following, reference being made to the accompanying drawing in which.

SPECIFIC DESCRIPTION

Figure 1:
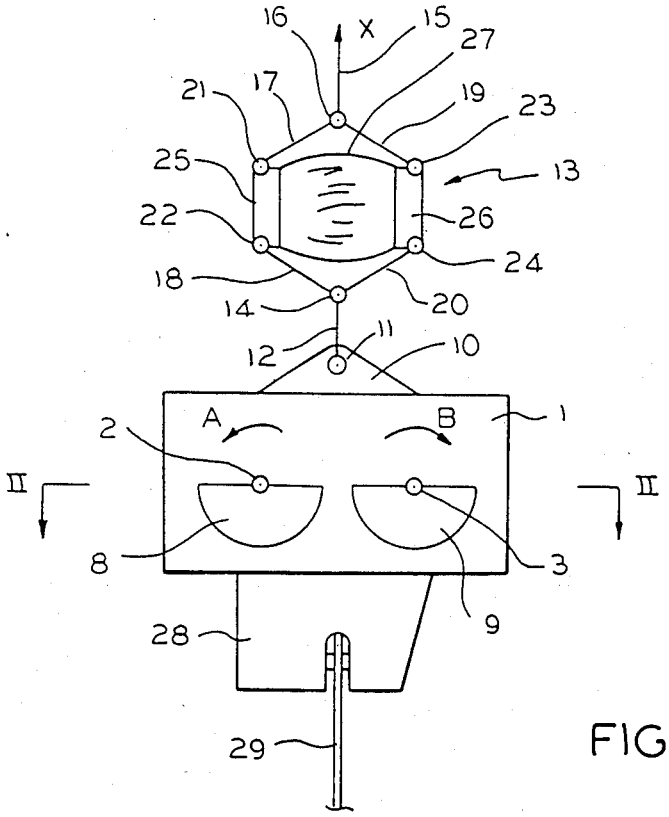
FIG. 1 is a side view of the hydraulic pile driver according to this invention.
Figure 2:
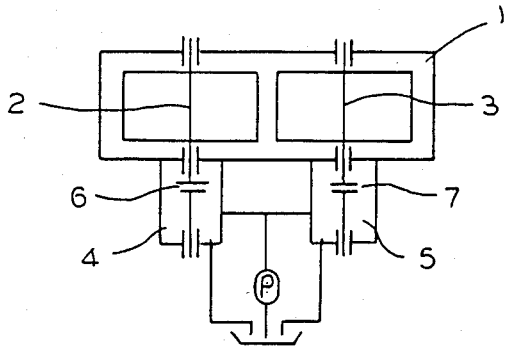
FIG. 2 is a section taken along line II—II of FIG. 1.

As seen in FIGS. 1 and 2 the pile driver according to this invention has a rigid housing 1 in which are journaled two parallel and horizontally spaced shafts 2 and 3 that project from the housing 1 into two separate and respective hydrostatic motors 4 and 5 to which they are attached by elastic couplings 6 and 7. The shafts 2 and 3 are provided with respective semicylindrical offcenter weights 8 and 9 and the motors 4 and 5 are set up such that they rotate the two shafts 2 and 3 in respective directions A and B that are opposite each other.

Figure 3:
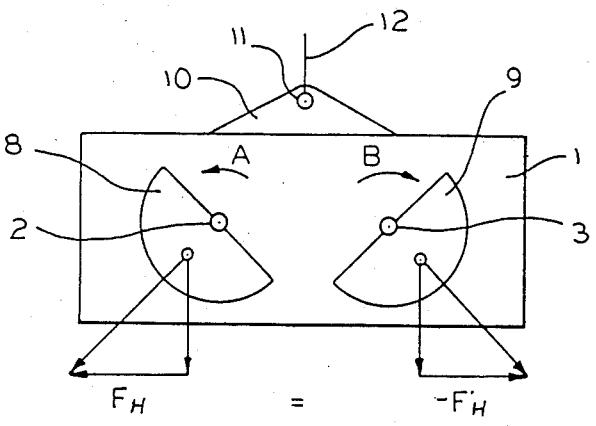
FIG. 3 is a diagram illustrating the operational principles of the driver according to this invention.

With this system, as illustrated in FIG. 3, the horizontal components of force $F_H$ will always be equal and opposite and the system will be self-synchronizing, thereby eliminating the need for any linking between the two shafts 2 and 3. These components $F_H$ cancel each other out in the horizontal direction, but are vertically additive, creating the desired vertical vibratory effect. The two motors 4 and 5 can be fed from a common source of fluid under pressure, here indicated schematically in FIG. 2 as a hydrostatic pump P.

The housing 1 is provided on its lower side with a clamp 28 for securing it to a sheet pile 29. On its upper side it has a flange 10 formed with an eye 11 into which is hooked an inextensible element 12 such as a hook 12 pivoted at 14 on the bottom of a vibration damper 13. An inextensible tension element 15, here the cable of a crane, is pivoted at 16 on the top of the damper 13. Flexible links 17 and 19 connect the pivot 14 to pivots 21 and 23 at the top ends of rigid link plates 25 and 26 provided at their lower ends with pivots 22 and 24 to which are connected the outer ends of further flexible links 18 and 20 whose lower ends are conneced to the pivot 14. These links 17, 18, 19, and 20 are cables.

Braced between the plates 25 and 26 is a hollow and barrel-shaped spring element 27 formed of an elastomer such as polyurethane or a polyamide and of sufficient compressibility to allow the plates 25 and 26 to move toward and away from each other. The pivots 21, 22, 23, and 24 all define horizontal pivot axes parallel to the shafts 2 and 3 and therefore prevent horizontal displacements of the housing 1 from being transmitted up to the crane cable 15. Vertical displacements of the housing 1 are largely canceled out as they compress the spring element 27.

Figure 4:
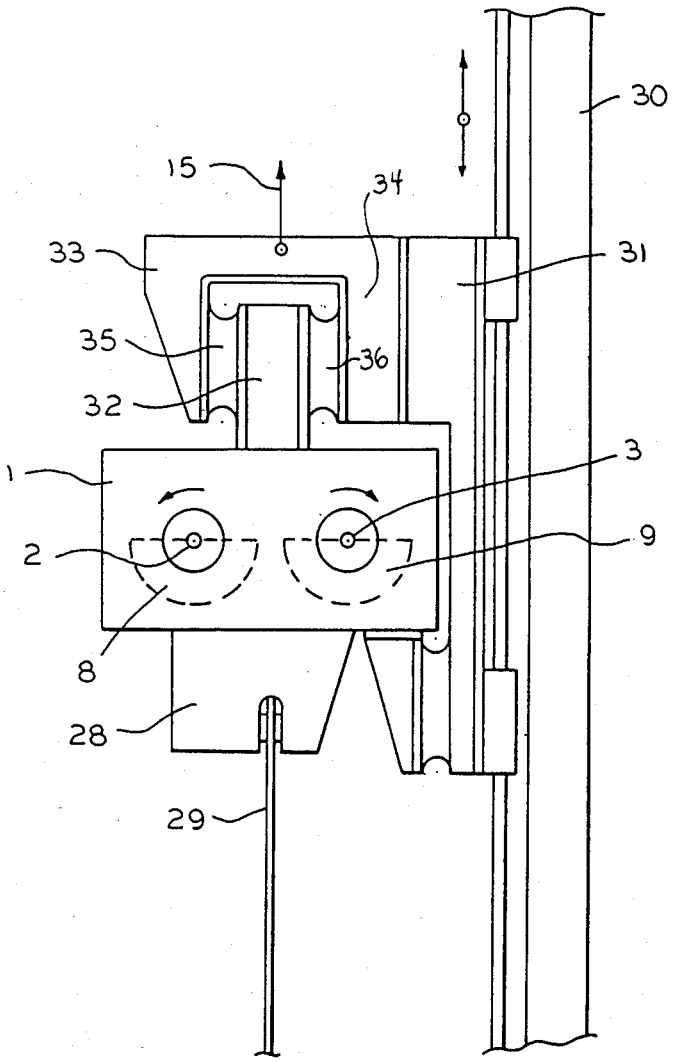
FIG. 4 is a side view like FIG. 1 of another driver according to the invention.

The arrangement of FIG. 4, in which references identical to those of FIGS. 1 through 3 are used for identical structure, is vertically guided by an upright post 30. To this end the housing 1 has on its top a heavy-duty flange 32 received between the sides 33 and 34 of a yoke-shaped housing 31 that is shaped to be guided on the flange of the beam 30. Respective elastomeric blocks 35 and 36 are engaged between the flange 32 and the sides 33 and 34 of the guide 31. Thus shear forces in these blocks 35 and 36 vertically support the housing 1 from the guide 31, allowing quite some vertical displacement of the housing 1 relative to the guide 1, while horizontal forces are converted into compression of the blocks 35 and 36, thereby inhibiting such horizontal displacement and in part causing the above-described self-synchronization of the rotation of the shafts 2 and 3. Since the resistance to compression is much greater than the resistance to shear, the spring blocks 35 will be much stiffer in the horizontal direction than in the vertical one.

I claim:

1. A vibratory pile driver comprising a rigid vibratory housing;

a least two parallel and horizontally spaced shafts mounted in said housing for rotation independently of each other;

at least two massive weights eccentrically positioned on the respective shafts;

at least two hydraulic drive motors, each motor being connected to the respective shaft and weight so as to rotate said two shafts with the respective weights in opposite directions, said weights being arranged in said housing to be horizontally substantially oscillation-free and being positioned in a plane extending perpendicularly to a direction of piling; and a common pressure fluid pump connectec to both of said motors so that said motors are hydraulically coupled to each other by a common pipe connecting said motors with said common pressure fluid pump but said hydraulic motors are not mechanically coupled to each other, whereby said hydraulic motors are self-synchronized only by said hydraulic coupling to each other to cause a self synchronization of a number of revolutions of said weights without requiring of an application thereto of a forced synchronization by mechanical coupling to each other for generating a vertically directed force.

2. The hydraulic pile driver defined in claim 1, further including a vibration damper, said housing being vertically suspended on said damper.

3. The hydraulic pile driver defined in claim 2, wherein said vibration damper includes spring means and a plurality of flexible links connected to each other by pivots and enclosing said spring means.

4. The hydraulic pile driver defined in claim 1, further comprising an upright guide post;

a guide vertically slidable on the post; and elastomeric spring means between the guide and the housing permitting limited relative vertical displacement and inhibiting relative horizontal displacement.

5. The hydraulic pile driver defined in claim 4 wherein the guide is downwardly U-shaped and has a pair of sides, the housing having a part projecting upwardly between the sides of the guide, the elastomeric spring means including a pair of block wedged between the housing part and the sides of the guide.

6. The hydraulic pile driver defined in claim 1 wherein the motors are hydrostatic.

7. The hydraulic pile driver defined in claim 1 wherein the weights and shafts are substantially identical.

* * * * *

UNITED STATES PATENT AND TRADEMARK OFFICE

CERTIFICATE OF CORRECTION

PATENT NO. : 4,625,811

DATED : December 2, 1986

INVENTOR(S) : Josef-Gerhard Tuenkers

It is certified that error appears in the above-identified patent and that said Letters Patent is hereby corrected as shown below:

| | |
|---|---|
| Col. 2, line 1 | "If" should be instead --It-- |
| Col. 4, line 49 | "connectec" should be instead --connected-- |
| Col. 4, line 56 | "each other" should be instead --each other,-- |
| Col. 6, line 3 | "block" should be instead --blocks-- |

Signed and Sealed this

Twenty-second Day of September, 1987

*Attest:*

DONALD J. QUIGG

*Attesting Officer* *Commissioner of Patents and Trademarks*